US005632541A

United States Patent [19]

Uthoff

[11] Patent Number: 5,632,541

[45] Date of Patent: May 27, 1997

[54] LOCKING DEVICE FOR DRAWERS AND THE LIKE

[75] Inventor: Detlev Uthoff, Löhne, Germany

[73] Assignee: Paul Hettich GmbH & Co., Kirchlengern, Germany

[21] Appl. No.: 397,098

[22] PCT Filed: Jun. 23, 1994

[86] PCT No.: PCT/DE94/00736

§ 371 Date: Mar. 6, 1995

§ 102(e) Date: Mar. 6, 1995

[87] PCT Pub. No.: WO95/02349

PCT Pub. Date: Jan. 26, 1995

[30] Foreign Application Priority Data

Jul. 15, 1993 [DE] Germany ..... 9310582 U

[51] Int. Cl.[6] ..... A47B 88/04

[52] U.S. Cl. ..... 312/333; 312/348.1

[58] Field of Search ..... 312/333, 334.44, 312/348.1, 348.2, 334.46

[56] References Cited

U.S. PATENT DOCUMENTS

| | | | |
|---|---|---|---|
| 3,092,429 | 6/1963 | Barnes | 312/333 |
| 3,589,778 | 6/1971 | Olson | 312/334.46 X |
| 3,995,927 | 12/1976 | Stein | 312/333 |
| 4,065,196 | 12/1977 | Stein | 312/333 |
| 4,557,531 | 12/1985 | Röck et al. | 312/333 X |
| 5,181,772 | 1/1993 | Albiez | 312/348.2 X |
| 5,261,737 | 11/1993 | Faust et al. | 312/334.44 X |
| 5,439,284 | 8/1995 | Grabher | 312/334.6 |

FOREIGN PATENT DOCUMENTS

| | | | |
|---|---|---|---|
| 10421458 | 4/1991 | European Pat. Off. . | |
| 591666 | 4/1994 | European Pat. Off. | 312/334.1 |
| 4103045C1 | 8/1992 | Germany . | |
| 4301327 | 8/1993 | Germany | 312/334.6 |
| 938942 | 10/1963 | United Kingdom | 312/334.12 |
| 2081071 | 2/1982 | United Kingdom | 312/333 |
| 2133276 | 7/1984 | United Kingdom | 312/334.33 |
| WO-A19011033 | 10/1990 | WIPO . | |

*Primary Examiner*—Peter M. Cuomo
*Assistant Examiner*—Janet M. Wilkens
*Attorney, Agent, or Firm*—Henry M. Feiereisen

[57] ABSTRACT

A locking device for detachably securing drawers or the like onto a guide rail, includes at least one locking element secured to the forward end of the movable part of the guide rail. The locking element (10) includes a spring-elastic actuating arm (14) which is equipped with a locking lug (17) receiving vertical forces. The slidable part of the guide rail (3) is equipped with a second locking lug (6) which receives horizontal forces and can also form part of the locking element (10).

10 Claims, 9 Drawing Sheets

LOCKING DEVICE FOR DRAWERS AND THE LIKE

BACKGROUND OF THE INVENTION

The invention refers to a locking device for detachably securing drawers, pullouts, sliders or the like to a guide rail, including at least one locking element secured to the forward end of the movable part of the guide rail.

Such locking devices are known. The known locking devices have however the drawback of carrying visible, i.e. easily accessible actuating means. This is optically less pleasing. Moreover, the easy accessibility increases the risk of an unintentional detachment, with all adverse consequences like danger of accident, damage, etc.

When heavy, e.g. filled sliders, drawers, pullouts and the like are vehemently opened or closed, relatively great braking forces and acceleration forces may be encountered which will significantly strain the locking devices. This may lead to destruction or to deformations of the locking means which adversely affect the locking operation. This is serious when keeping the risk of accident in mind.

SUMMARY OF THE INVENTION

It is an object of the invention to create a highly stressable locking device which is easy to operate while eliminating undesired operating errors and which is invisible as far as possible, i.e. not optically disturbing, and can be secured quickly and without any problem.

This object is attained by providing the locking element with a first spring-elastic actuating arm which includes a locking means preferably receiving vertical forces, and by providing the locking element and/or the slideable part of the guide rail in the support area of the drawer with a second locking means which receives horizontal forces.

Further advantageous embodiments of the invention are described in the subclaims.

The advantages attained by the invention are in particular that each locking means receives forces acting in a certain direction (horizontal/vertical).

Thus, the horizontal forces generated in direction of the guide rails during opening/closing of the drawer, pullout or the like are received by first locking means and the vertical forces acting in direction of a lift-off of the drawer, pullout or the like are absorbed by a second locking means.

The partly significant horizontal forces encountered during violent opening/closing of large and fully packed drawers, pullouts and the like and effecting an acceleration/deceleration are received without any problems by the suitably arranged first locking means/locking lugs without experiencing any of the previously described troubles.

BRIEF DESCRIPTION OF THE DRAWING

Two preferred exemplified embodiments will now be described in more detail with reference to the drawings, in which.

DETAILED DESCRIPTION OF PREFERRED EMBODIMENTS

The first exemplified embodiment illustrated in FIGS. 1 to 6*b* shows a conventional guide rail 1 which is not described in more detail and includes a support 2 secured to a piece of furniture and a guide part 3 slidably mounted on the support 2 and secured to a drawer.

Mounted to the forward end for of the drawer-side guide part 3 is a locking element 10. The locking element 10 carries a mounting element 10*a* (FIGS. 4, 6) which has a cross sectional contour matching the clear contour of the drawer-side guide part 3 so that the mounting element 10*a* is retained accurately in position by the drawer-side guide part 3 after being inserted therein. The final attachment onto the guide part 3 is attained by screws, rivets, formed locking lugs, through crimping, embossing etc.

Figure 5:
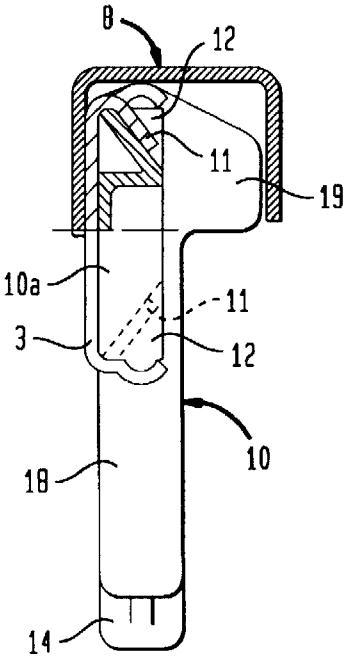
FIG. 5 is a sectional view of the locking element along the line V—V of FIG. 6 in assembled state.
Figure 4:
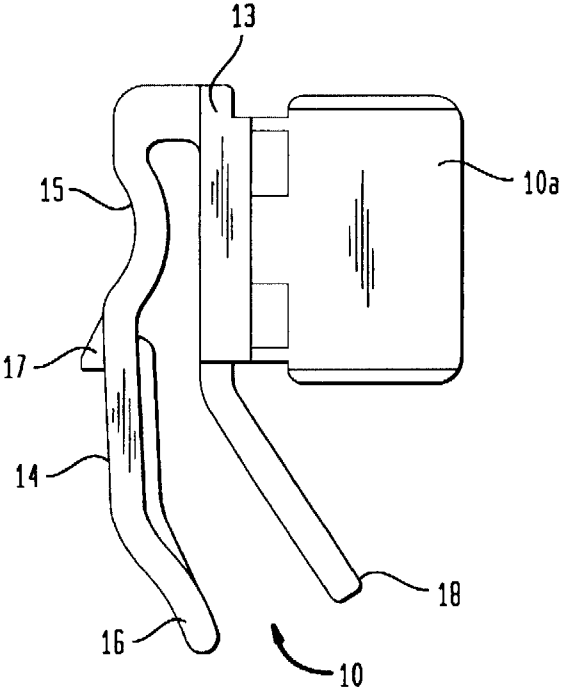
FIG. 4 is a side view of the locking element.
Figure 6B:
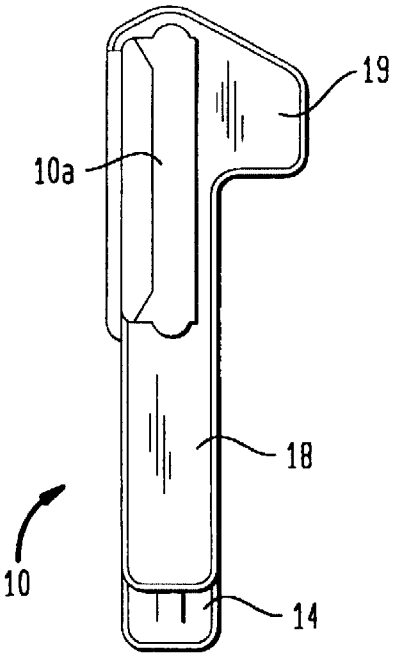
FIG. 6*b* is a side view of the locking element in direction of arrow D.
Figure 6:
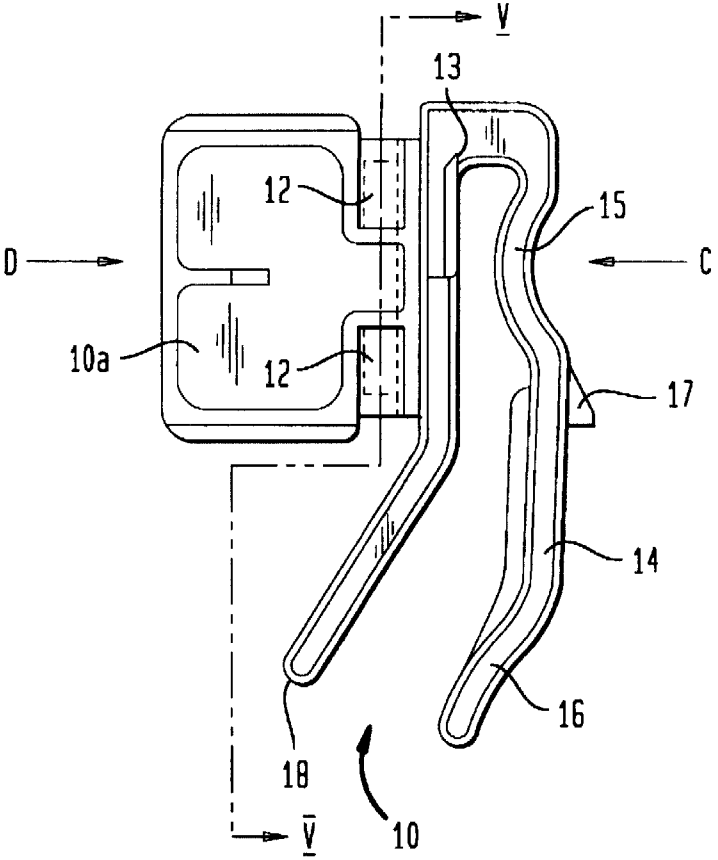
FIG. 6 is a plan view of the locking element.

In the illustrated exemplified embodiment, the mounting element 10*a* is effected by lugs 11 pushed out from the guide part 3 and engaging respective recesses 12 which are arranged on the mounting element 10*a* (FIGS. 5, 6).

The area 13 of the locking element 10 that is not hidden in the guide part 3 is formed at the top with a first spring-elastic actuating arm 14 which extends downwardly approximately in parallel relationship to the front plate 7 of the drawer 8. The actuating arm 14 extends in an arc 15 and terminates in an angled section 16 which moves away from the drawer front plate 7 to facilitate the access. The arc 15 improves the elasticity/deformability of the actuating arm 14. In midsection, the actuating arm 14 is formed with a locking lug 17 which cooperates in a manner still to be described with a snap-in opening 9 of the drawer 8 and extends parallel to the drawer front plate 7.

Figure 6A:
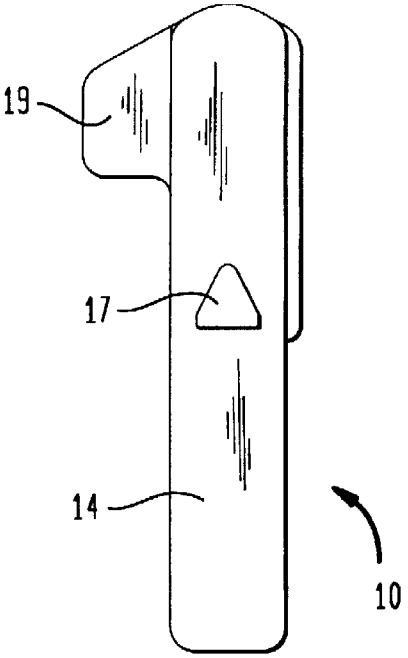
FIG. 6*a* is a side view of the locking element in direction of arrow C.

Formed on the bottom of the area 13 is a second, essentially rigid actuating arm 18 which operates in a manner still to be described. As shown in FIGS. 5, 6*a*, the locking element 10 is formed with a further projection 19 by which the drawer 8 is retained essentially without play in lateral direction.

Provided in the forward section of the drawer 8 in the support area of the drawer 8 upon the guide part 3 is a further snap-in opening 5 which cooperates with a locking lug 6 of the locking element or the guide part in a manner also still to be described.

In the exemplified embodiment shown in FIGS. 1 to 6*b*, this locking lug 6 is bent out from the drawer-side guide part 3 of the guide rail 1. Certainly, the locking lug 6 could also be formed on the locking element 10. The embodiment according to the illustrated example (FIG. 2*a*) is however advantageous because the guide part 3 and the drawer 8 are made of metal or sheet, thereby creating a highly stressable locking mechanism on the basis of sheet or metal which is especially suitable for large, fully packed i.e. heavy drawers and the like. It should also be kept in mind that a rapid, violent opening/closing results in an acceleration/deceleration of great masses which—as mentioned—generates in direction of movement forces that are not to be underestimated and could significantly strain the locking mechanism formed by snap-in opening 5 and locking lug 6.

Figure 3:
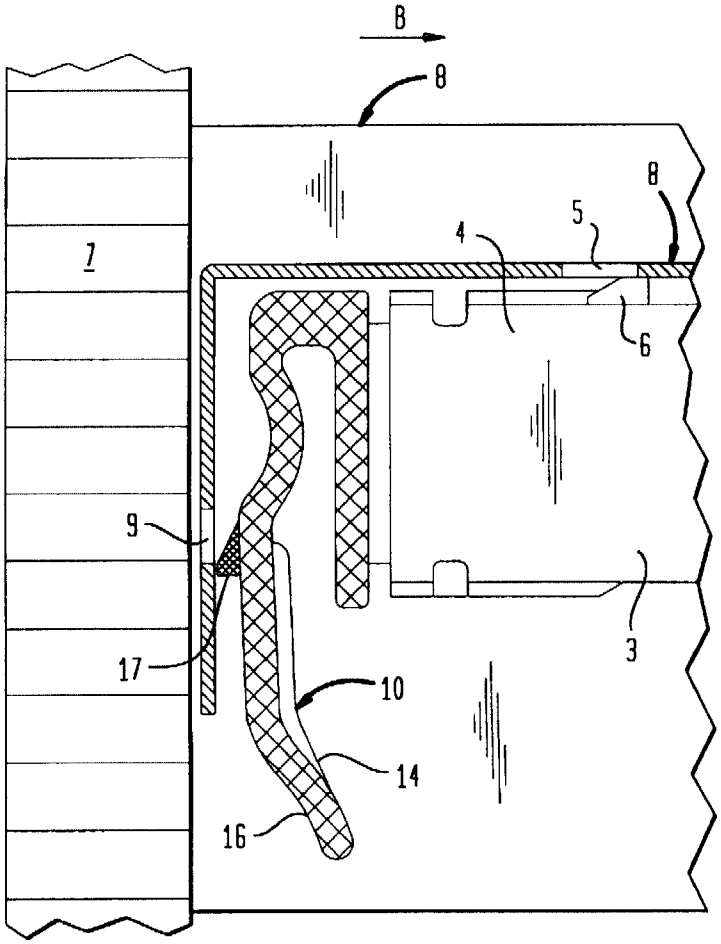
FIG. 3 is an illustration according to FIG. 2, with the drawer not yet locked.

FIG. 3 clearly shows the mode of operation of the described locking mechanism: The drawer 8 is placed upon the extracted guide rails 1 and guide part 3 according to FIG. 3 and then pushed in direction of arrow B into the body of the piece of furniture.

It should be noted that the end of the drawer 8 and the end of the guide part 3 is formed with conventional locking means which are not described in more detail and include hooks/eyelets or the like and by which the drawer 8 is secured at its rear end to the guide pad 3 against lift-off during the mentioned insertion of the drawer 8 in direction of arrow B. These locking elements do not form part of this invention and thus are not described in more detail.

During shift of the drawer 8 in direction of arrow B, the forward area of the drawer 8 is configured according to FIG. 3 in which the guide part 3 bears upon a conventional stop which is not described in more detail and is disposed within the guide rail 1 to prevent any further displacement in direction of arrow B: The actuating arm 14 with its locking lug 17 resiliently backs off by a small amount upon further shifting of the drawer 8 in direction of arrow B. When the snap-in opening 5 and locking lug 6 coincide in the support area of the drawer 8 upon the guide part 3, the own weight of the drawer 8 causes the latter to engage with its snap-in opening over the locking lug 6.

Figure 1:
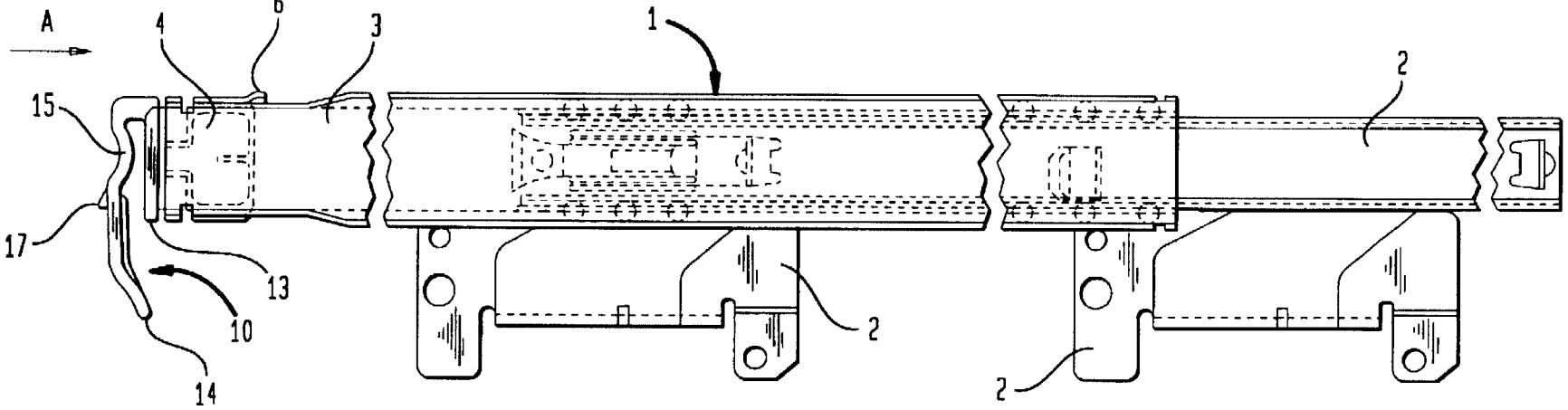
FIG. 1 is a plan view of a guide rail of a first exemplified embodiment with a first locking element being inserted.
Figure 1A:
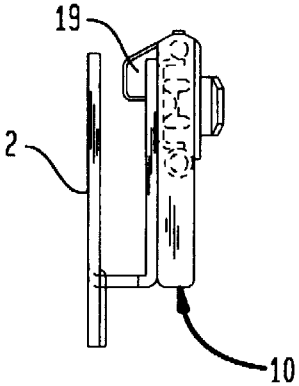
FIG. 1*a* is a side view of FIG. 1, viewed in direction of arrow A of FIG. 1.
Figure 2:
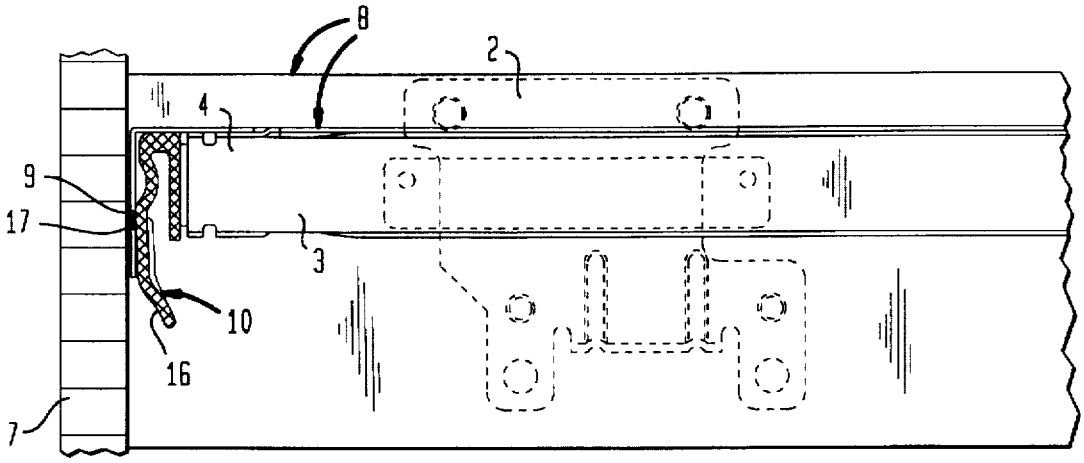
FIG. 2 is an illustration according to FIG. 1, however with attached and locked drawer.
Figure 2A:
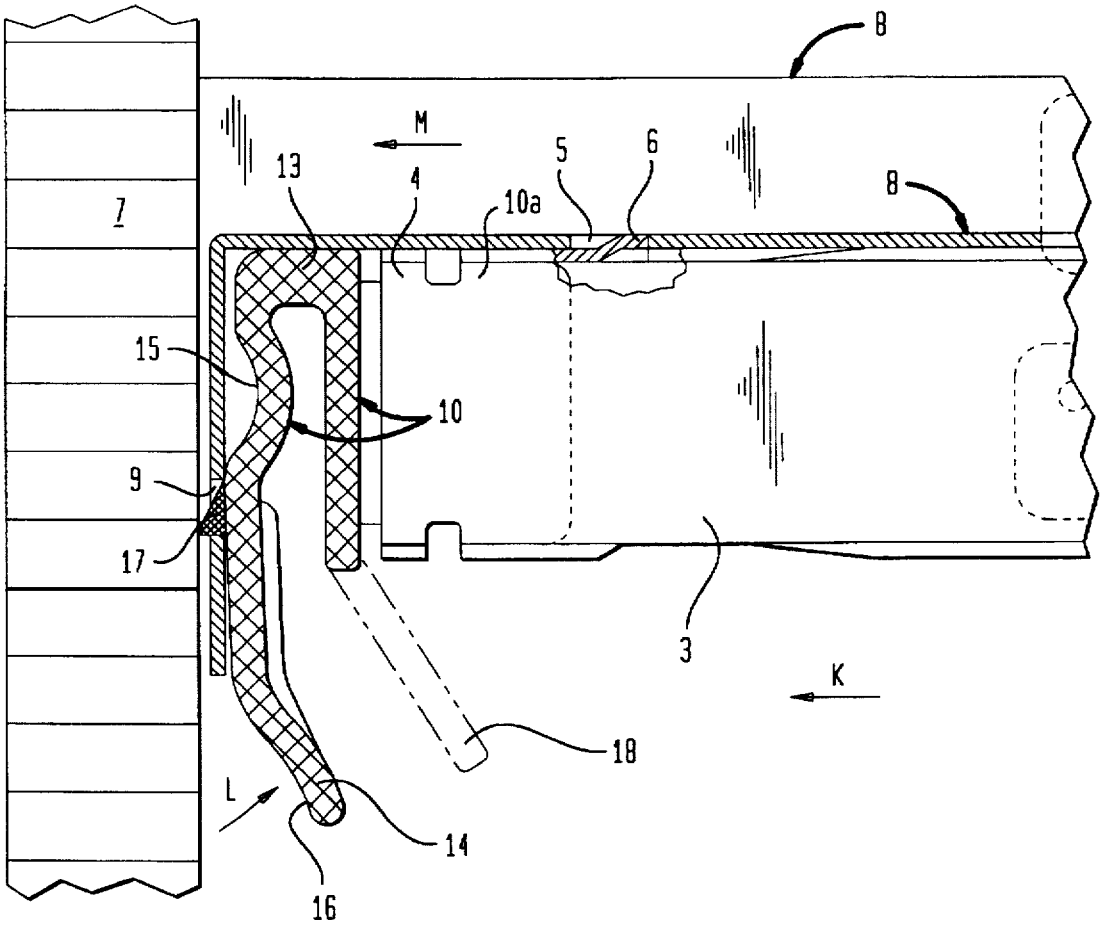
FIG. 2*a* is an enlarged illustration of FIG. 2.

This slight movement of the drawer 8 in vertical direction effects at a same time that the locking lug 17 coincides with the snap-in opening 9, and the spring-loaded actuating arm 14 pushes the locking lug 17 into the snap-in opening 9. The drawer occupies now its final position and is properly locked, that is in horizontal direction—in direction of the pull-out motion—by the locking means 5, 6, and in vertical direction by the locking means 9, 17 (FIG. 2*a*). At the rear end of the drawer 8, the conventional not described locking means become effective—as mentioned above—during attachment.

Unfavorable manufacturing tolerances may under certain circumstances cause a failure of the guide part 3 to reach the previously mentioned, not described end stop within the guide rail 1 while the drawer front plate 7 already bears upon the furniture body so that the shift of the drawer 8 in direction of the arrow B terminates without effecting the desired lock between drawer 8 and guide part 3.

In such cases, the lock can be effected by having the operator grasp the above-mentioned second actuating arm 18 and to draw the latter—and thus also the guide part 3—in direction of the arrow K towards the front plate 7 of the drawer (FIG. 2*a*) to effect in this manner the above-described lock between the drawer 8 and the guide part 3.

In order to separate the drawer 8 from the guide rails 1 and the guide part 3, the operator pushes the actuating arm 16 in direction of arrow L (FIG. 2*a*) to thereby disengage the locking means 9, 17 and to allow a retraction and lifting of the drawer 8 in direction of arrow M, with the not described locking mechanism at the rear of the drawer 8 disengaging and allowing a complete detachment of the drawer 8 from the guide pads 3.

FIGS. 7 to 12*b* show a second exemplified embodiment in which the drawer 8 is secured to a so-called full pullout/over pullout. In general, full pullout/over pull-out refers generally to multi-link guide rails which permit a complete withdrawal of the drawer or the like from the furniture body. The different spatial extension of such full pullouts/over pullouts require an adjustment of the locking element.

Figure 9:
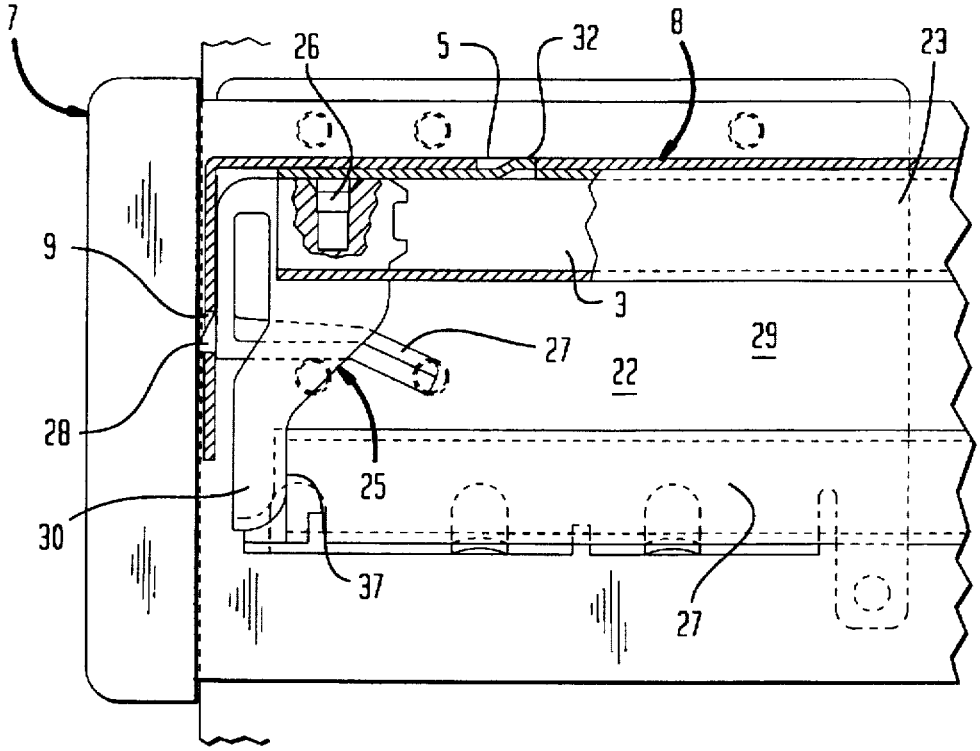
FIG. 9 is a partially sectional illustration according to FIG. 7, with attached and locked drawer.
Figure 10:
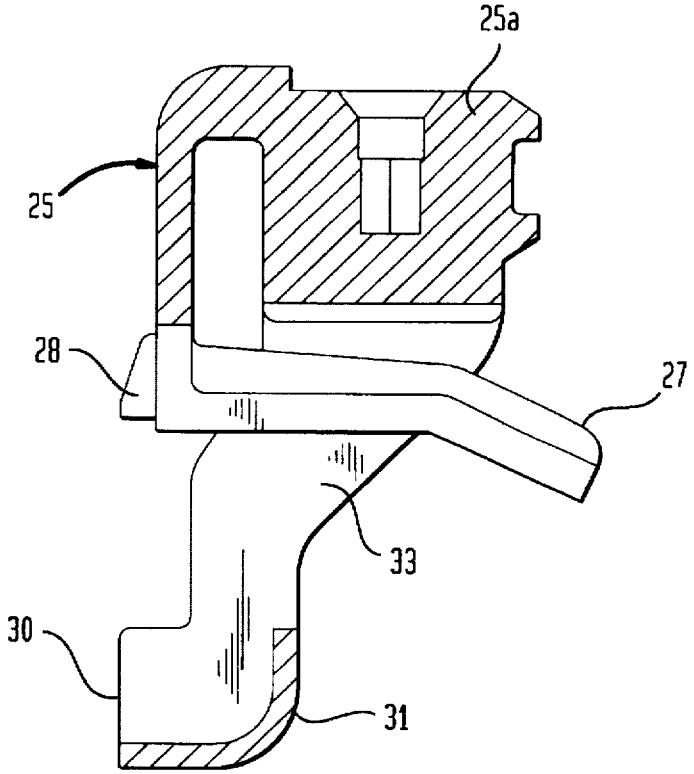
FIG. 10 is a sectional view of the locking element.
Figure 11B:
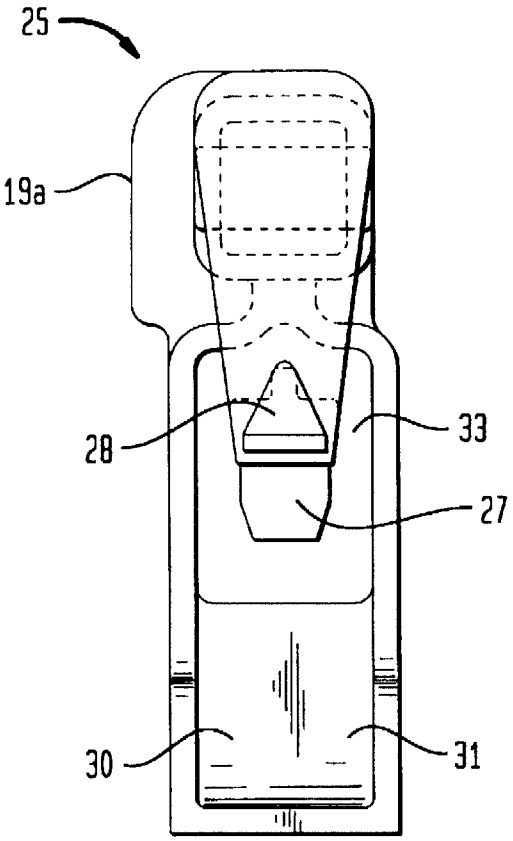
FIG. 11*b* is a side view of the locking element in direction of arrow G of FIG. 11.
Figure 11:
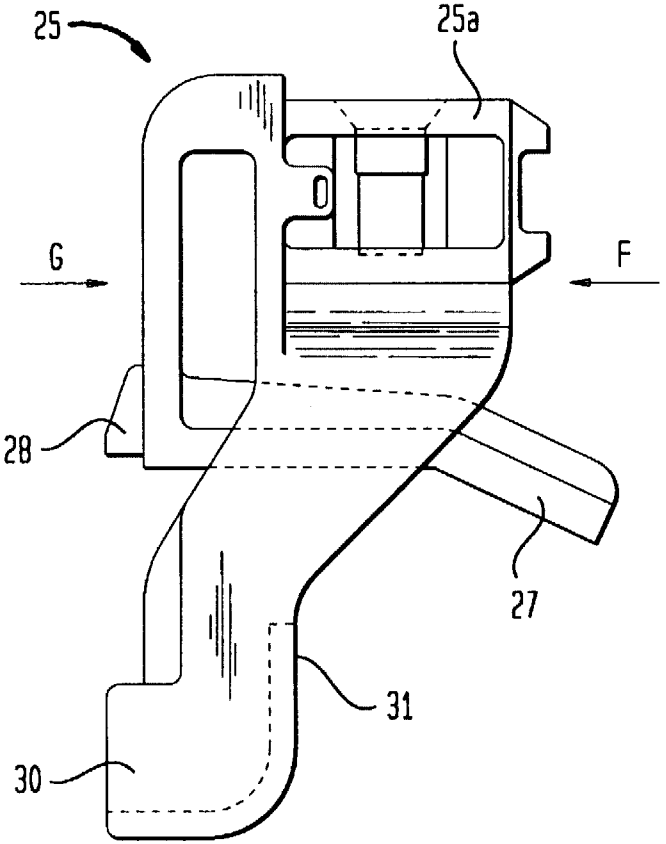
FIG. 11 is a plan view of the locking element.
Figure 11A:
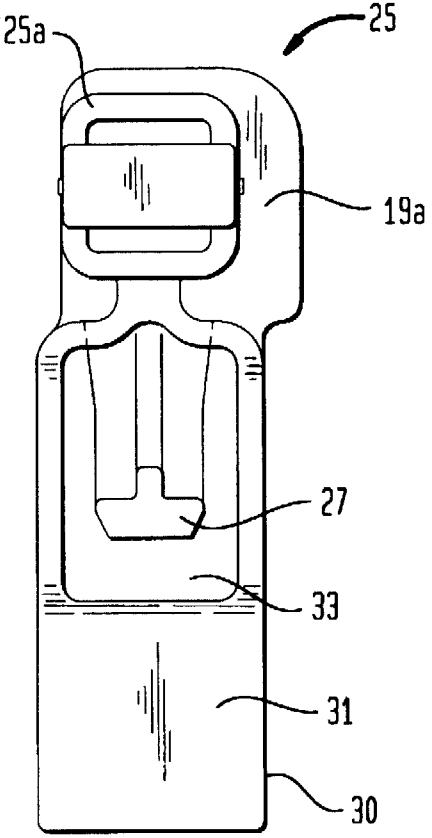
FIG. 11*a* is a side view of the locking element in direction of arrow F of FIG. 11.

As shown in FIGS. 9, 10, the locking element 25 is also inserted with a mounting element 25*a* in the drawer-side guide pad 23 and secured there, as described in the first exemplified embodiment—through crimping, embossing, or by rivet, pin, screw 26 etc.

Figure 8A:
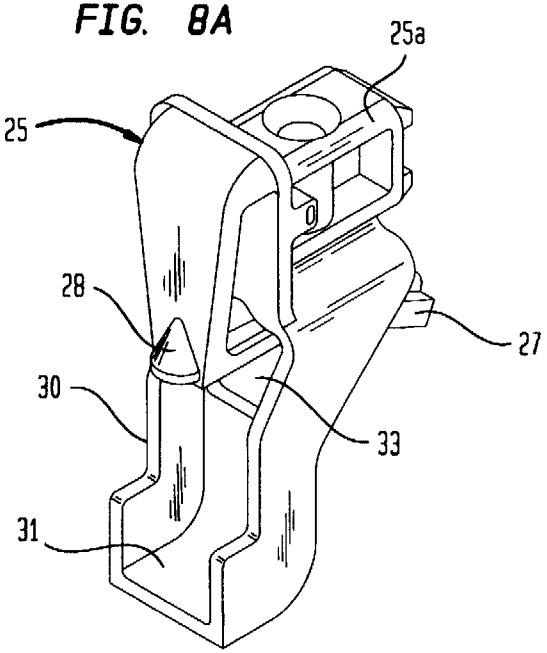
FIG. 8*a* is a perspective illustration of the locking element.
Figure 8:
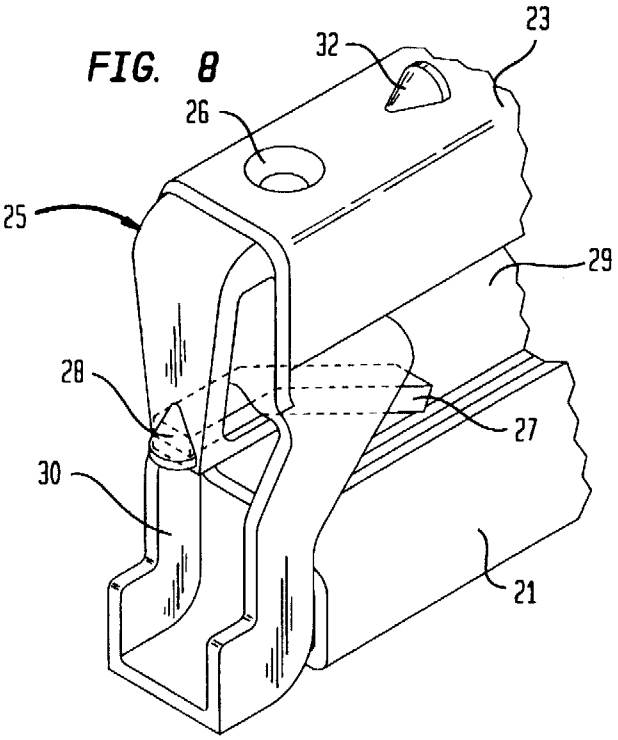
FIG. 8 is a perspective illustration of the locking element inserted in the guide rail.
Figure 7A:
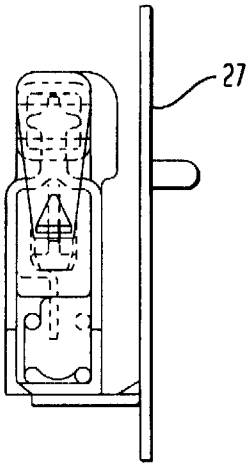
FIG. 7*a* is a side view of the FIG. 7, viewed in direction of arrow E of FIG. 7.

The first actuating arm 27 with the locking lug 28 is angled in such manner as to face the intermediate space 29 which is formed in the inserted stage of the drawer 8 by support part 21 and guide pad 23 (FIGS. 8, 9).

Figure 7:
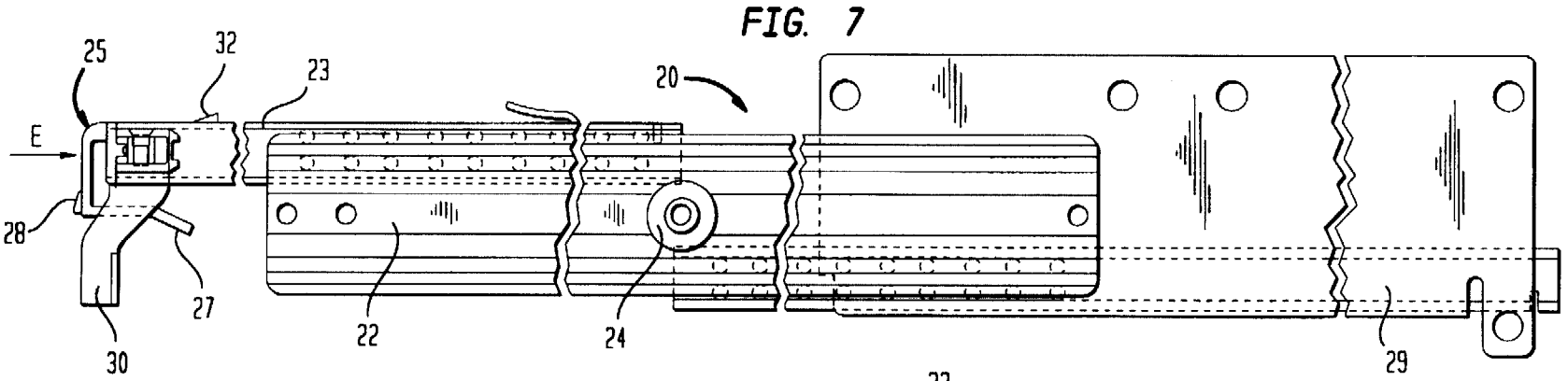
FIG. 7 is a plan view of a guide rail of a second exemplified embodiment with a locking element being inserted.

As shown in FIG. 7, the guide rail 20 is formed in a known manner by a furniture-side support part 21, an intermediate link 22 slidably mounted thereon, and a guide part 23 also slidably mounted on the upper part of the intermediate link 22 and secured to the drawer.

In other words, the intermediate element 22 forms with the furniture-side support part 21 a first pullout guide mechanism and with the drawer-side guide part 23 a second pullout guide mechanism, with the pullout motion being synchronized by a friction roller 24 which is known per se.

In an analog fashion as the first exemplified embodiment (FIG. 4), also this embodiment includes a further actuating arm 30 directed essentially downwards. On the one hand, this actuating arm 30 may be a stop surface 31 for the first pullout guide mechanism comprised of support part 21 and intermediate link 22 (FIG. 9). On the other hand, it may also serve as actuator mechanism in case—as described in the first exemplified embodiment—unfavorable manufacturing tolerances prevent a normal locking of the drawer 8 onto the guide part 23 during insertion of the drawer 8, by pushing the guide part 23 in a manner as described in the first exemplified embodiment in direction of the drawer front plate 7 to effect in this manner the desired lock.

Also in this exemplified embodiment, the locking is effected by a first snap-in opening 5 of the drawer 8 for cooperation with a projecting locking lug 32 of the guide part 23, and by a second snap-in opening 9 of the drawer 8 in the area of the drawer front plate 7 for cooperation with the locking lug 28 formed on the first actuating arm 27.

As shown in FIGS. 8 to 11*b*, the second actuating arm 30 carries a hollow space 33 which can be penetrated by the first actuating arm 27 to thereby ensure that actuating arm 30 is able to assume its stop or limiting function (FIG. 9) and, on the other hand, that the actuating arm 27 is easily accessible when the drawer 8 is opened (FIG. 12*b*) and does not interfere when the drawer 8 is pushed in.

Figure 12:
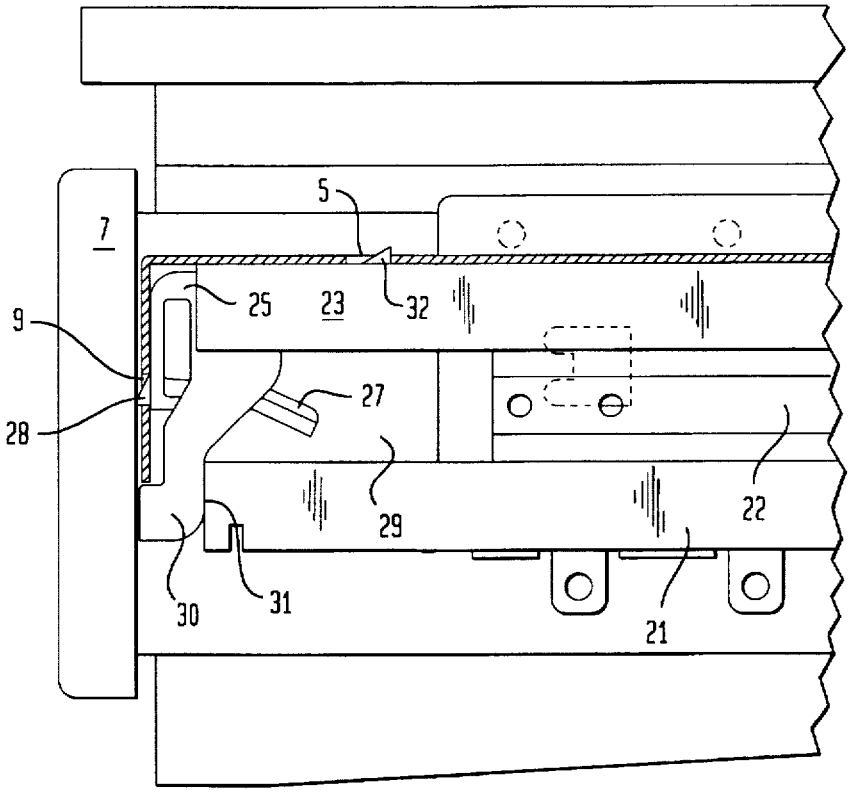
FIG. 12 is an illustration according to FIG. 9 with partially illustrated body of a piece of furniture.
Figure 12A:
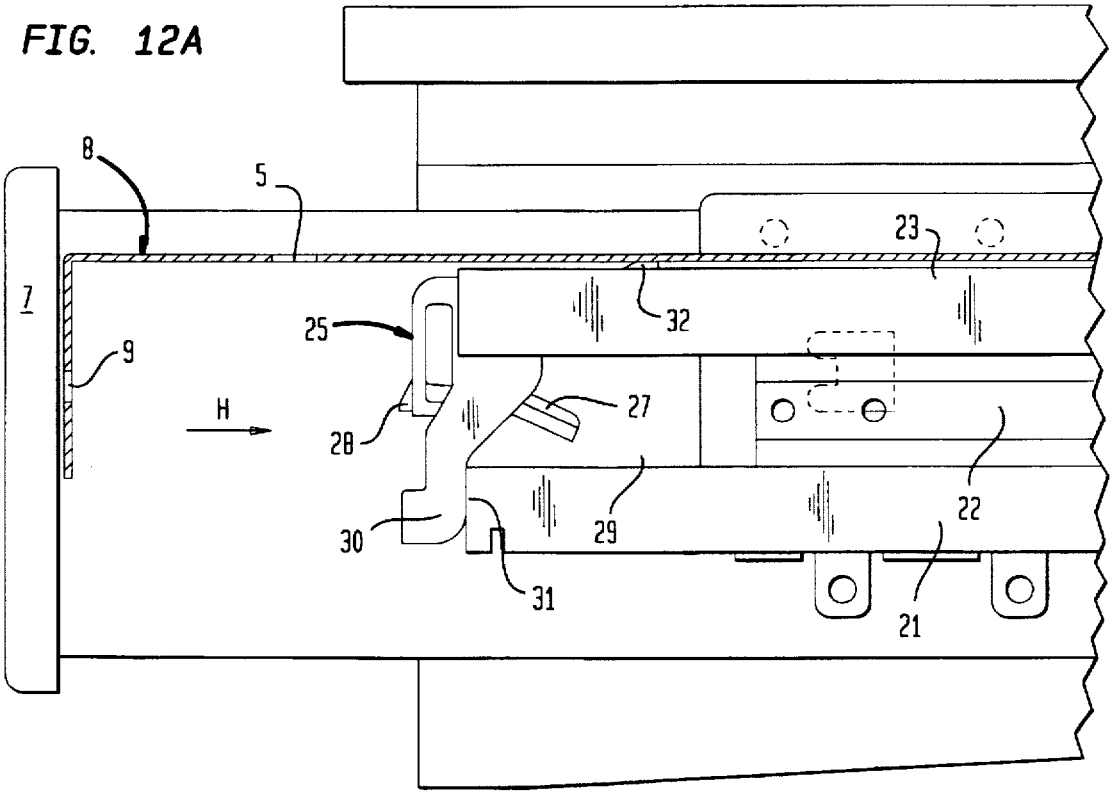
FIG. 12*a* is an illustration according to FIG. 12, with the drawer attached to the guide rails but not yet locked.

The locking of the drawer 8 with the guide part 23 is effected in the same manner as described in the first exemplified embodiment: Placement and insertion of the drawer 8 in direction of arrow H (FIG. 12*a*), or pull of the guide part 23 by means of the actuating arm 30 in direction of the drawer front plate 7 at retracted drawer 8.

Also in this case, the locking means which are known per se and not described in more detail become effective at the rear end of the drawer.

Figure 12B:
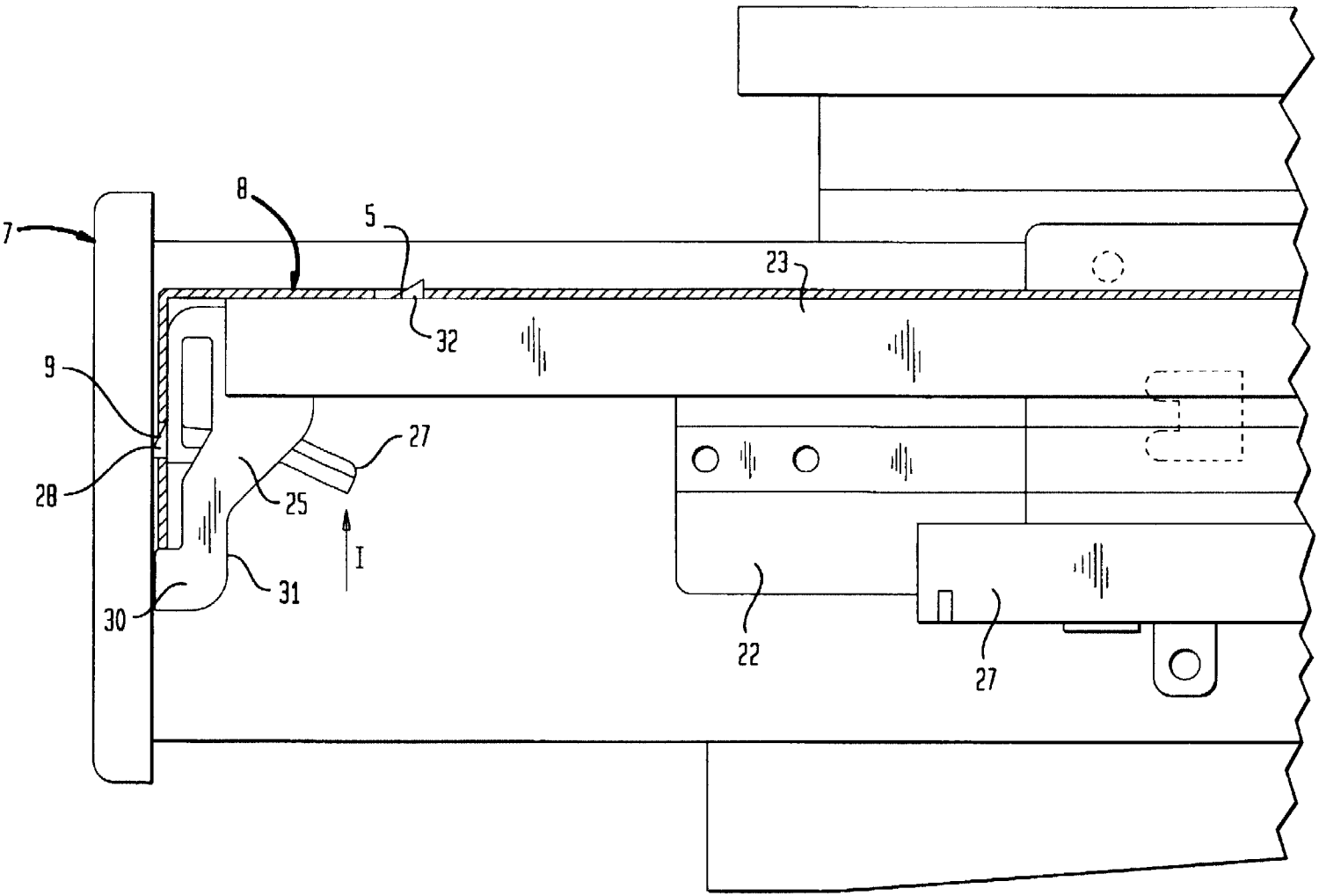
FIG. 12*b* is an illustration according to FIG. 12, with locked and retracted drawer.

If the drawer 8 should be detached from the guide part 23, the actuating arm 27 is pushed at retracted drawer 8 in direction of arrow I (FIG. 12*b*). The locking means 9, 28 disengage and the drawer 8 can then be lifted and withdrawn from the guide rails and from the guide part 23.

I claim:

1. A drawer slide assembly, comprising:

a support rail attached to an article of furniture;

a guide rail received in the support rail for displacement in a horizontal direction;

a drawer defining an axis and exhibiting a first snap-in opening extending perpendicular to the axis and a second snap-in opening extending parallel to the axis; and a locking mechanism for detachably securing the drawer to the guide rail assembly, said locking mechanism including first locking means in form of a locking element received in one end of the guide rail and including a spring-elastic actuating arm for engagement in the first snap-in opening of the drawer to secure the drawer in vertical direction, and second locking means for engagement in the second snap-in opening of the drawer for securing the drawer in horizontal direction.

2. The drawer slide assembly of claim 1 wherein the locking element includes a first lug for engagement in the first opening.

3. The drawer slide assembly of claim 2 wherein the second locking means includes a second lug for engagement in the second opening.

4. The drawer slide assembly of claim 2 wherein the guide rail includes the second locking means which further includes a second lug for engagement in the second opening.

5. The drawer slide assembly of claim 2 wherein the elastic actuating arm is formed with the first lug, said locking element further including an essentially rigid actuating arm at a slight distance to the spring elastic actuating arm.

6. The drawer slide assembly of claim 5 wherein the essentially rigid actuating arm includes a hollow space for engagement by the spring elastic actuating arm.

7. The drawer slide assembly of claim 1 wherein the drawer is formed with a front plate, said first opening of the drawer being formed in proximity of the locking element in a support area extending parallel to the guide rail, and said second opening of the drawer being formed in an area extending approximately parallel to the front plate.

8. The drawer slide assembly of claim 1 wherein the locking element is formed with a mounting piece that matches a clear contour of the guide rail for attachment in the guide rail.

9. The drawer slide assembly of claim 8 wherein the mounting piece is secured in the guide rail in an interlocking manner.

10. The drawer slide assembly of claim 1 wherein the locking element is formed with a lateral projection for retaining the drawer in lateral direction relatively free of clearance.

* * * * *

UNITED STATES PATENT AND TRADEMARK OFFICE

CERTIFICATE OF CORRECTION

PATENT NO. : 5,632,541

DATED : May 27, 1997

INVENTOR(S) : Detlev Uthoff

It is certified that error appears in the above-indentified patent and that said Letters Patent is hereby corrected as shown below:

Column 6, line 12, change "elastic" to --spring-elastic--;

Column 6, lines 14 and 18, change "spring elastic" to --spring-elastic--.

Signed and Sealed this

Twenty-third Day of September, 1997

*Attest:*

*Attesting Officer*

BRUCE LEHMAN

*Commissioner of Patents and Trademarks*